US007229507B2

(12) United States Patent
Fukumoto et al.

(10) Patent No.: US 7,229,507 B2
(45) Date of Patent: Jun. 12, 2007

(54) HIGH SPEED TOOL STEEL

(75) Inventors: Shiho Fukumoto, Yasugi (JP); Keiji Inoue, Yasugi (JP)

(73) Assignee: Hitachi Metals, Ltd., Tokyo (JP)

( * ) Notice: Subject to any disclaimer, the term of this patent is extended or adjusted under 35 U.S.C. 154(b) by 416 days.

(21) Appl. No.: 10/798,320

(22) Filed: Mar. 12, 2004

(65) Prior Publication Data

US 2004/0200552 A1 Oct. 14, 2004

(30) Foreign Application Priority Data

Apr. 9, 2003 (JP) ..... 2003-105387

(51) Int. Cl.

| | |
|---|---|
| ***C22C 38/22*** | (2006.01) |
| ***C22C 38/24*** | (2006.01) |
| ***C22C 38/26*** | (2006.01) |
| ***C22C 38/44*** | (2006.01) |
| ***C22C 38/30*** | (2006.01) |

(52) U.S. Cl. ..... 148/333; 148/334; 148/328; 420/104; 420/111; 420/110

(58) Field of Classification Search ..... 420/111, 420/110, 105, 104; 148/334, 333, 328, 654, 148/663

See application file for complete search history.

(56) References Cited

U.S. PATENT DOCUMENTS 4,459,162 A * 7/1984 Norstrom et al. ..... 420/106

FOREIGN PATENT DOCUMENTS

| | | |
|---|---|---|
| JP | 1-152242 | * 6/1989 |
| JP | 2000-328195 | * 11/2000 |
| JP | 2001-123247 | * 5/2001 |
| JP | 2003-55747 | * 2/2003 |

OTHER PUBLICATIONS

Patent Abstracts of Japan, Publication No. 02-008347, Jan. 11, 1990; Hitachi Metals.

Patent Abstracts of Japan, Publication No. 04-111962, Apr. 13, 1992; Daido Steel Co., Ltd.

Patent Abstracts of Japan, Publication No. 04-111963, Apr. 13, 1992; Daido Steel Co., Ltd.

Patent Abstracts of Japan, Publication No. 02-125845, May 14, 1990; Hitachi Metals, Ltd.

esp@cenet —Document Bibliography and Abstract; New Nickel-Chromium-Molybdenum-vanadium Hot Work Steel; Patent No. DE19531260; Feb. 27, 1997; Buderus Edelstahlwerke AG (DE).

* cited by examiner

*Primary Examiner*—Deborah Yee
(74) *Attorney, Agent, or Firm*—Sughrue Mion, PLLC

(57) ABSTRACT

A high speed tool steel, which is high in impact value and free from variations in tool performance, comprising, by mass %, of: 0.4≦C≧0.9; Si≦1.0; Mn≦1.0; 4≦Cr≧6; 1.5–6 in total of either or both of W and Mo in the form of (½W+Mo) wherein W≦3; 0.5–3 in total of either or both of V and Nb in the form of (V+Nb); wherein carbides dispersed in the matrix of the tool steel have an average grain size of ≦0.5 μm and a dispersion density of particles of the carbides is of ≧80×10$^3$ particles/mm$^2$.

4 Claims, 9 Drawing Sheets

EFECT OF COOLING SPEED AFTER SOAKING
(SOAKING 1280℃)→T℃/h→TEMP. →AC

AS CAST 1,200℃ × 10h SOAKING 1,260℃ × 10h SOAKING 1,280℃ × 10h SOAKING 1,300℃ × 10h SOAKING

GIST OF SEM IMAGE ANALYSIS

EFECT OF COOLING SPEED AFTER SOAKING
(SOAKING 1280℃)→T℃/h→TEMP. →AC

| Temp | COOLING SPEED | | | |
|---|---|---|---|---|
| | 300℃/h | 150℃/h | 75℃/h | 30℃/h |
| 1000℃ | | | | |
| 900℃ | | | | |

FAN COOLING
(≦180℃/h)
INVENTION METHOD

COMPARATIVE METHOD

INVENTION METHOD

COMPARATIVE METHOD

INVENTION METHOD

COMPARATIVE METHOD

HIGH SPEED TOOL STEEL

BACKGROUND OF THE INVENTION

1. Field of the Invention

The present invention relates to a high speed tool steel excellent in cold strength, wear resistance and in hardenability and also to a method for manufacturing such high speed tool steel. More particularly, the present invention relates to a high speed tool steel particularly excellent in hot strength and in toughness with a minimum variation in tool performance when used as a material for: a metallic mold used for forming plastics; and, a swaging tool, for example such as a press forming die, a press forming punch and like tools.

2. Description of the Related Art

Heretofore, widely used as materials in production of: a tool such as a press forming punch used in hot precision press working; and, a metallic mold used for forming plastics, are those excellent in hot strength or toughness, for example such as: a hot working tool steel of the type "AISI H19"; and, a high speed tool steel of the type "AISI M2". However, these conventional types of tool steels are still poor in toughness and like mechanical properties. This often leads to breakage and occurrence of heat cracks of a tool product made of the conventional types of tool steels in use.

More particularly, in case of the former steel (i.e., hot working tool steel), this type of steel is low in carbon content and therefore low in cold strength. Due to this, the former steel often suffers from its poor resistance to fatigue and poor wear resistance together with its breakage in use.

On the other hand, in case of the latter steel (i.e., conventional type of the high speed tool steel), the applicant of the subject Patent application has previously proposed, in Japanese Patent Laid-Open application No. H02-8347 (Laid open in 1990): a high speed tool steel, which is improved in cold/hot strength and toughness so as to improve a product made of this type of steel in crack resistance and in resistance to fatigue at high temperatures in use. The product made of this type conventional tool steel is excellent in tool performance. On the other hand, in order to realize the mass production of such product made of the tool steel, it is necessary to produce a large-sized steel ingot. However, such large-sized ingot often varies in composition of its carbides. Due to the presence of variations in composition of the carbides, the product made of the tool steel obtained from the large-sized steel ingot often varies in tool performance even when the product is sufficiently controlled in quality during its production processes.

Also proposed by the applicant in another Japanese Patent Laid-Open application No. H04-111962 (Laid open in 1992) is a method for manufacturing a high speed tool steel. This method employs a conventional electro-slag melting process to reduce anisotropy in mechanical properties of a tool product made of the tool steel, and improves the product in tool life. However, the product made of the tool steel is still poor in toughness in use.

SUMMARY OF THE INVENTION

Under such-circumstances, the present invention was made to solve the problems inherent in the prior art. Consequently, it is an object of the present invention to provide a high speed tool steel and its manufacturing method, in which a tool product made of the high speed tool steel is improved in toughness and in tool performance by reduction of variations in tool performance.

In order to accomplish the above object of the present invention, the inventors of the present invention have researched in detail on the microstructure of the high speed tool steel, and found that: "the variations in tool performance are caused by the presence of variations in composition of carbides in the tool steel". In other words, the inventors of the present invention have found that it is possible to improve in tool performance the product of the tool steel by reducing the variations in composition of the carbides contained in the tool steel.

More particularly, a tool product such as a metallic mold used for forming plastics is produced from the tool steel by using various types of production process such as heating, annealing and machining, through which the tool steel is formed into a completed shape and dimensions of the product. After the shape and dimensions of the tool product are completed, the tool product is then subjected to a quenching or hardening process and then to a tempering process, through which the tool product is controlled in hardness. After the tool product is controlled in hardness, the tool product is subjected to a suitable finishing process to become a finally completed tool product. Due to this, the tool performance of the product is substantially determined by the composition of carbides contained in the tool product after completion of these quenching and tempering processes. The inventors of the subject application have found that "the composition of the carbides contained in the tool product after completion of the quenching and the tempering process largely depends on production conditions of the tool product". In view of these findings, the present invention was made to have a first and a second aspect.

In accordance with the first aspect of the present invention, the above object of the present invention is accomplished by providing:

A high speed tool steel comprising, by mass percentage, a basic composition of: a 0.4–0.9% of C; an equal to or less than 1.0% of Si; an equal to or less than 1.0% of Mn; a 4–6% of Cr; a 1.5–6% in total of either or both of W and Mo in the form of (½W+Mo) wherein the amount of W is not more than 3%; and, a 0.5–3% in total of either or both of V and Nb in the form of (V+Nb), wherein an average grain size of precipitated carbides dispersed in the matrix of the tool steel is equal to or less than 0.5 μm and a dispersion density of the carbides is equal to or more than $80\times10^3$ particles/$mm^2$.

In the high speed tool steel of the present invention described above, preferably an Ni content is equal to or less than 1% by mass percentage.

Further, in the high speed tool steel described above, preferably a Co content is equal to or less than 5% by mass percentage.

Still further, in the high speed tool steel described above, preferably an Ni content is equal to or less than 1% by mass percentage, and a Co content is equal to or less than 5% by mass percentage.

On the other hand, in accordance with the second aspect of the present invention, the above object of the present invention is also accomplished by providing:

A method for manufacturing a high speed tool steel comprising, by mass percentage, a basic composition of: a 0.4–0.9% of C; an equal to or less than 1.0% of Si; an equal to or less than 1.0% of Mn; a 4–6% of Cr; a 1.5–6% in total of either or both of W and Mo in the form of (½W+Mo) wherein the amount of W is not more than 3%; and, a 0.5–3% in total of either or both of V and Nb in the form of (V+Nb), wherein an ingot of the steel is prepared by an electro-slag melting process, heated to a temperature of from 1200° C. to 1300° C., subjected to a soaking process, and then cooled down to a temperature of equal to or less than 900° C. at a cooling rate of equal to or more than 3° C./minute in surface temperature of the ingot.

In the above method for manufacturing the high speed tool steel, after completion of the soaking and the cooling process of the ingot, preferably the ingot is subjected to a hot working process, and then subjected to a quenching and a tempering process.

In the above method for manufacturing the high speed tool steel, after completion of the soaking and the cooling process of the ingot, the ingot is subjected to a hot working process, and then subjected to preferably a machining process followed by a quenching and a tempering process.

In the above method for manufacturing the high speed tool steel, preferably an Ni content of the high speed tool steel is equal to or less than 1% by mass percentage.

In the above method for manufacturing the high speed tool steel, preferably a Co content of the high speed tool steel is equal to or less than 5% by mass percentage.

Further, in the above method for manufacturing the high speed tool steel, preferably an Ni content is equal to or less than 1% by mass percentage, and a Co content is equal to or less than 5% by mass percentage.

In the tool steel of the present invention, both the C content and the other elements forming the carbides of the tool steel are controlled in balance so as to: reduce the so-called "stripe (i.e., streak)" combined structure or network of the carbides in its distribution in the matrix of the tool steel; and, form fine granular crystals of the carbides by an appropriate amount in the tool steel. Further, in the tool steel of the present invention, an appropriate amount of each of Ni and Nb is added to the tool steel to enhance such formation of the fine granular crystals of the carbides in the matrix of the tool steel. Such addition of Ni and Nb to the tool steel may improve the tool steel in resistance to softening of the tool steel at high temperatures. Due to the formation of such fine granular crystals of the carbides in the matrix of the tool steel and such addition of Ni and Nb to the tool steel, the tool steel of the present invention is remarkably improved in tool performance.

Hereunder, first of all, description will be given to advantageous effects of each of elements in chemical composition of the tool steel of the present invention as well as reasons for restricting the amount of each of the elements of the tool steel.

In the tool steel, carbon or C is combined with the other elements such as Cr, W, Mo, V, Nb and the like to form two types of primary carbides both high in hardness. Consequently, addition of an appropriate amount of C in composition to the tool steel is effective in improving the tool steel in wear resistance.

Further, since the element C is partially solid-soluble in the matrix of the tool steel, it may contribute to improvement of the matrix in strength. However, when the C content in composition of the tool steel is excessively large, segregation of the carbides is enhanced. On the other hand, when the tool steel is poor in the C content in composition, such tool steel fails to obtain a necessary hardness. For these reasons, in the tool steel of the present invention, the C content is limited to an amount of ranging from 0.4 mass % to 0.9 mass %.

As for Si, since it is necessary for the tool steel to contain the element Si as a deoxidizer, the tool steel contains the element Si as one of its inevitable impurities. However, when the Si content in the tool steel is in excess of 1.0 mass %, the tool steel suffers from excessive hardness even after completion of annealing of the steel. Such excessive hardness decreases the cold-working properties of the tool steel. For these reasons, in the tool steel of the invention, the Si content is limited to an amount of up to 1.0 mass %. In addition, the element Si is also recognized to be effective in transforming the primary carbides of stick-shaped $M_2C$ type into finely-divided spheroidal carbides. For this reason too, it is preferable to limit the Si content to an amount of equal to or less than 0.1 mass % in the tool steel of the present invention.

As for Mn, addition of the element Mn to the tool steel is effective in improving the tool steel in hardenability. However, when the Mn content is too large, the $A_1$ transformation point of the tool steel is excessively lowered, which means that the hardness of such tool steel is excessively increased even after completion of annealing. Therefore, this results in the tool steel poor in machinability. For these reasons, in the tool steel of the present invention, the Mn content is limited to an amount of up to 1.0 mass %. Incidentally, in order to improve the tool steel in hardenability, it is preferable to add the element Mn to the tool steel by an amount of at least 0.1 mass %.

As for Cr, the element Cr combines with C to form the carbides in the tool steel to improve the steel in both wear resistance and hardenability. However, when the Cr content is too large, stripe- or streak-like segregation of the carbides increases in the matrix of the tool steel. This deteriorates the tool steel in cold-rolling or -working properties. On the other hand, when the Cr content is too small, any effective improvement can't be obtained in the tool steel. For these reasons, in the tool steel of the present invention, the Cr content is limited to an amount of ranging from 4 mass % to 6 mass %.

As for W and Mo, these elements W and Mo combine with C to form the carbides in the tool steel, and are solid-soluble in the matrix of the tool steel to improve the steel in hardness after completion of a heat treatment of the steel. Due to such improvement of the tool steel in hardness, the tool steel is also improved in wear resistance. However, when the content of each of these elements W and Mo is too large, stripe- or streak-like segregation of the carbides increases in the matrix of the tool steel, which impairs the cold working properties of the tool steel.

For these reasons, the content of each of these elements W and Mo is so defined as to be: a 1.5–6 mass % in total of either or both of W and Mo in the form of (½W+Mo) wherein the amount of W is not more than 3 mass %. The reason for limiting the W content to not more than 3 mass % is in that: when the W content is in excess of 3 mass %, the stripe- or streak-like segregation of the carbides increases to impair the tool steel in toughness.

As for V and Nb, these elements V and Nb combine with C to form the carbides in the tool steel. Due to such formation of the carbides in the matrix of the tool steel, the steel is improved in wear resistance and also in resistance to seizure. Further, since these elements V and Nb are solid-soluble in the matrix of the tool steel in the quenching process of the steel, segregation of fine particles of the carbides occurs in tempering process of the tool steel.

These fine particles of the carbides are substantially free from any agglomeration in the matrix of the tool steel. Due to this, the tool steel is remarkably improved in resistance to softening at high temperatures. In other words, the tool steel is remarkably improved in yield strength at high temperatures by addition of these elements V and Nb to the tool steel. Further, these elements V and Nb are effective in formation of fine crystals of the carbides in the matrix of the tool steel. This formation of fine crystals of the carbides may improve the tool steel particularly in toughness, and increases the $A_1$ transformation point of the tool steel. Due to this, the tool steel is also improved in resistance to heat checks.

Further, the element Nb is effective in improving the tool steel in resistance to softening at high temperatures. Therefore, the element Nb may improve the tool steel in hot strength, and is effective in preventing the carbides from growing in grain size during the quenching process of the tool steel. However, when the content of each of these elements V and Nb is too large, the carbides grow into large-sized grains. This facilitates occurrence of longitudinal cracks extending in a direction, in which direction the tool steel or ingot is subjected to hot working manipulations such as a hot-rolling operation and the like. On the other hand, when the content of each of these elements V and Nb is too small, the mold, which is made of the tool steel and used for forming plastics, suffers from its surface's premature softening at high temperatures.

For these reasons, the content of each of these elements V and Nb is defined so as to be: a 0.5–3 mass % in total of either or both of V and Nb in the form of (V+Nb).

In addition, it is also possible for the tool steel of the present invention to comprise other additional elements Ni and Co in composition.

As for Ni, this element Ni is effective in improving the tool steel in hardenability as is in each case of C, Cr, Mn, Mo, W and the like. Further, the element Ni may contribute to formation of a martensite-predominant microstructure of the tool steel. When this type of microstructure is formed in the tool steel, the tool steel is essentially improved in toughness. However, in case that the Ni content is too large, the $A_1$ transformation point of the steel is excessively lowered. This impairs the tool steel in resistance to fatigue. As a result, a tool product made of this tool steel is shortened in tool life. In addition, the tool steel suffers from an excessively large hardness even after completion of the tempering process thereof, which may also impair the tool steel in machinability. For these reasons, the Ni content is limited to an amount of up to 1 mass %, and preferably more than 0.05 mass %.

As for Co, the element Co is capable of forming a densely packed protective oxide layer on the surface of the tool steel when a tool product made of this tool steel is used at high temperatures in machining a workpiece. Such protective oxide layer of the tool steel is extremely dense and excellent in adhesion property. Due to the presence of this protective oxide layer in the interface between the workpiece and the tool product: it is possible to keep the tool product substantially out of metal-contact with the workpiece in its machining operation; and, it is also possible to prevent the tool product from being excessively heated during the machining operation. In other words, an extreme increase in temperature of the surface of the tool product is effectively prevented. This leads to an improvement of the tool steel in wear resistance. Due to such formation of the protective oxide layer on the surface of the tool product, the tool product is improved in heat isolation property and also in resistance to heat checks. In other words, in the tool steel of the present invention, such heat checks are effectively prevented from occurring. However, when the Co content is too large, the tool steel is impaired in toughness. Consequently, the Co content is limited to an amount of up to 5 mass %, and preferably more than 0.3 mass %.

The balance of the tool steel of the present invention in composition is substantially Fe. In other words, the total content of Fe plus elements other than elements mentioned above is limited to an amount of up to 10 mass %, and preferably up to 5 mass %. As for the balance of the tool steel of the present invention in composition, such balance maybe Fe and inevitable impurities, too.

As a result of further investigation of breakage of the mold and like tool product made of the tool steel, the inventors have found that: the premature breakage of the tool product is substantially caused by the presence of coarse agglomerated carbides precipitated in the microstructure of the tool product.

Based on this finding, in the high speed tool steel of the present invention, an average grain size of such precipitated carbides dispersed in the matrix of the steel is limited to an amount of equal to or less than 0.5 μm. Further, the dispersion density of particles of such carbides is limited to an amount of equal to or more than $80\times10^3$ particles/mm$^2$.

In other words, in the tool steel of the present invention, a large number of fine particles of the carbides are uniformly dispersed in the matrix of the tool steel, so that the carbides are prevented from agglomerating or being formed into coarse grains in the matrix of the tool steel. Here, dispersion of the carbides in the matrix of the tool steel means no presence of agglomerated carbides in the microstructure of the tool steel.

In order to manufacture the high speed tool steel of the present invention, the steel ingot having the chemical composition described above is preferably subjected to an electro-slag melting process, a vacuum arc melting process or like remelting process, through which process the steel ingot is melted again. In other words, since the steel ingot is subjected to such remelting process, the tool steel of the ingot is improved in fineness of its microstructure so as to be free from any large segregation of its ingredients. Such segregation is inherent in the conventional large steel ingot. The remelting process, which is employed in the embodiment, is particularly effective in reducing the amount of each of precipitated impurities in the steel ingot. For this reason, it is preferable to employ the electro-slag remelting process in manufacturing the high speed tool steel of the present invention.

Further, it is also possible to improve the tool steel of the ingot in the distribution density of the carbides by conducting a soaking operation of the ingot at a temperature of ranging from 1200° C. to 1300° C. In this hot soaking operation, the coarse grains of the carbides are solid-solved in the matrix of the tool steel, and formed into fine grains dispersed uniformly in the matrix of the tool steel together with the other ingredients or elements of the tool steel. This leads to the improvement of the tool steel in the distribution density of the carbides, as described above.

Consequently, it is preferable to conduct the soaking operation of the steel ingot at a temperature of ranging from 1200° C. to 1300° C. for a period of time ranging from 10 hours to 20 hours.

In contrast with a conventional soaking operation conducted at a temperature of approximately 1150° C., the hot soaking operation inherent in the present invention is conducted at a higher temperature than the conventional soaking temperature.

In a method for manufacturing the conventional type of high speed tool steel, in order to save energy, the steel ingot having been subjected to the conventional soaking operation keeps its temperature as constant as possible so as to not lose in heat energy after completion of the soaking operation. The thus kept ingot is directly reheated and subjected to hot working manipulations, for example such as hot-rolling, hot-pressing or forging and like hot working manipulations, and bloomed into a desired billet having a predetermined shape and dimensions.

In contrast with this, in the present invention different from the prior art, the steel ingot of the tool steel of the present invention is temporarily cooled down to a temperature of equal to or less than 900° C. at a cooling rate of more than 3° C./minute in surface temperature of the ingot. After that, the ingot is reheated to a hot working temperature and subjected to the hot working manipulation and bloomed into a desired billet having a predetermined shape and dimensions.

Since the high speed tool steel of the present invention contains the elements C, W, Mo, and V in composition as described above, the microstructure of the tool steel is largely affected in material properties by its own heat history gained in the manufacturing steps of the tool steel. Due to this, in order to improve the tool product made of the tool steel in tool performance, it is necessary to control such heat history of the tool steel. For this reason, the inventors have widely researched the holding temperature of the steel ingot in the soaking process and the cooling conditions of the ingot having the above chemical composition so as to determine its optimum holding temperature and its optimum cooling conditions. As a result, the inventors have found that the cooling conditions of the steel ingot after completion of the soaking operation are most effective factors in controlling the microstructure of the tool steel. Based on this finding, the tool product made of the tool steel of the present invention is remarkably improved in tool performance.

In other words, in the method of the present invention for manufacturing the high speed tool steel, the ingot of tool steel after completion of its hot soaking operation is quickly cooled down to a temperature of equal to or less than 900° C. at a cooling rate of equal to or more than 3° C./minute in surface temperature of the ingot. Such quick cooling operation inherent in the present invention permits the carbides of the steel ingot: to precipitate as fine particles or grains in the matrix of the tool steel; and, to reduce a hot staying period of time of the ingot in the cooling operation, which prevents the carbides from growing into coarse grains. As a result: coarse grains of precipitated carbides are remarkably reduced in amount; and, fine grains of precipitated carbides remarkably increases in amount, which leads to the improvement of the tool steel in tool performance and the reduction of variations in tool life.

Further, thus produced tool steel of the present invention is capable of obtaining a Charpy impact value of more than 100 J/cm$^2$. It is also possible for the tool steel of the present invention to obtain a Charpy impact value of even more than 200 J/cm$^2$ without suffering from any variation in tool performance.

Since a conventional type of high speed tool steel produced by the conventional manufacturing method permits agglomeration of the carbides in the matrix of the tool steel, the amount of the precipitated fine carbides dispersed in the matrix of the ingot of conventional tool steel reduces after completion of its quenching and tempering processes. Due to this, in the conventional tool steel of the ingot, the distribution density of grains or particles of the carbides having an average grain size of up to 0.5 μm is less than $10\times10^3$ particles/mm$^2$. Due to this, the conventional tool steel is poor in impact property. Namely, after completion of a heat treatment of the conventional tool steel, such conventional tool steel has a Charpy impact value of only ranging from 50 J/cm$^2$ to 80 J/cm$^2$, and is therefore poor in impact property. Due to this, when the conventional tool steel is used as a material of a punch tool, such punch tool often suffers from the premature fracture in use.

In view of the above disadvantages of the conventional tool steel, in the present invention, as described above, any precipitation of the carbides in the tool steel occurring in the form of agglomeration is prevented. Due to this, it is possible for the tool steel of the present invention to limit its Charpy impact value to a value of equal to or more than 100 J/cm$^2$, which prevents the tool steel of the present invention from suffering from any premature fracture in use when the tool steel is used as a material of the punch tool and like tool product. This leads to the improvement of the tool steel of the present invention in its tool life.

BRIEF DESCRIPTION OF THE DRAWINGS

The above and other objects, advantages and features of the present invention will be more apparent from the following description taken in conjunction with the accompanying drawings in which:

FIG. 8(*b*) is a schematic diagram illustrating a heating pattern of the tool steel in its production test conducted according to a comparative method other than the method of the present invention;

FIG. 9(*b*) is a photomicrograph of the microstructures of the tool steel (specimens) produced by a comparative method other than the method of the present invention;

FIG. 10(*b*) is an SEM photograph showing the microstructure of the precipitated carbides of the tool steel produced by a comparative method other than the method of the present invention.

DETAILED DESCRIPTION OF THE PREFERRED EMBODIMENTS

The best modes for carrying out the present invention will be described in detail using embodiments of the present invention with reference to the accompanying drawings.

Now, an embodiment of the present invention will be described in a concrete manner. Heretofore, the inventors of the present invention have diagnosed intensively a large number of reported "premature fractures" and eventually found out optimum conditions of a soaking process of an ingot of high speed tool steel of the present invention, which conditions will be described in connection with the following actual example:

EXAMPLE

Figure 1:
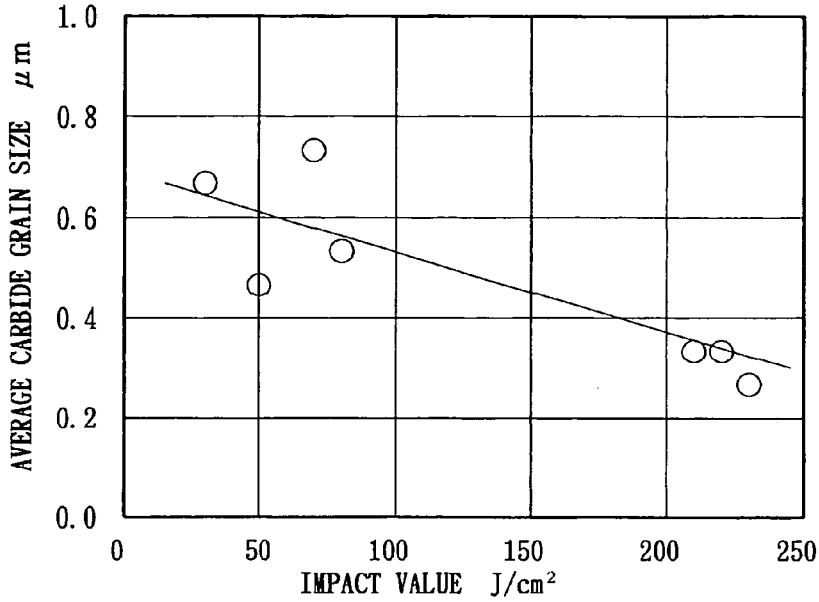
FIG. 1 is a graph showing the relationship between the impact value and the average grain size of the precipitated carbides of the tool steel after completion of the quenching and the tempering process of the tool steel.
Figure 2:
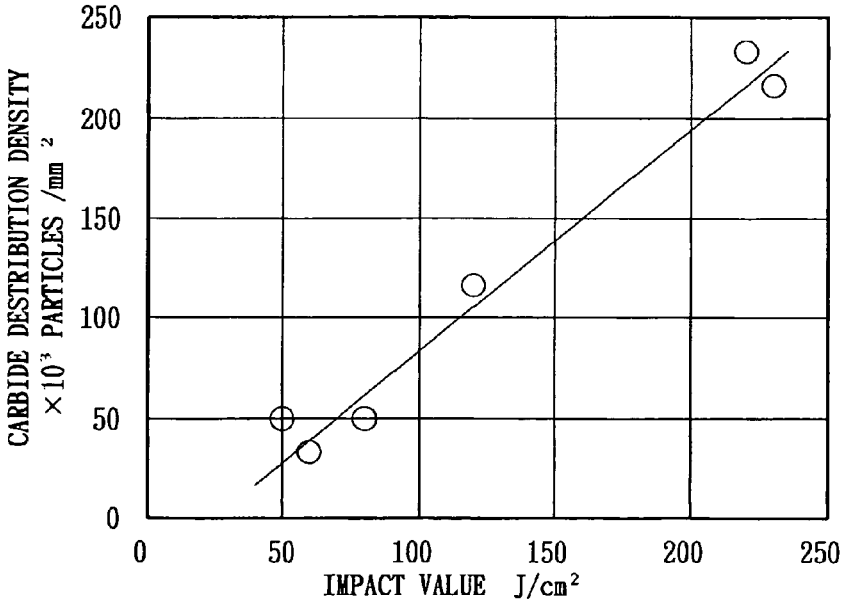
FIG. 2 is a graph showing the relationship between the impact value and the distribution density of the precipitated carbides after completion of the quenching and the tempering process of the tool steel.
Figure 11:
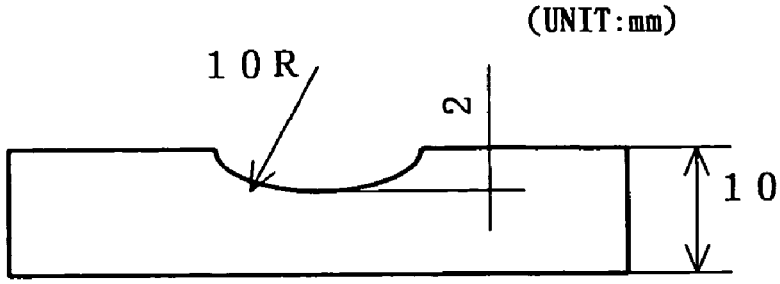
FIG. 11 is a schematic diagram illustrating one of notched test bars in shape and dimension, which one is called "10RC notched Charpy test bar" and used to measure the tool steel in impact value.

Re: The Research for Finding Out the Root Causes of the Premature Fractures:

In order to diagnose the premature fractures of a high speed tool steel, the inventors have researched the relationship between the impact value of the tool steel and each of: the average grain size of the precipitated carbides in the high speed tool steel; and, the distribution density of fine particles of the carbides in the tool steel. Specimens were obtained from the tool steel. Each of these specimens was first quenche data temperature of 1140° C., and then subjected to a tempering process at a temperature of 560° C. After that, the thus prepared specimen was subjected to a so-called "C-notched Charpy impact test" to determine the impact value of the tool steel. In this "C-notched Charpy impact test", the specimen which was equal, in shape and dimension, to a "10RC notched Charpy test bar" shown in FIG. 11 was used. The test results of this "C-notched Charpy impact test" are shown in FIGS. 1 and 2. Based on these drawings, the inventors have found that some relationship exists between the impact value of the tool steel and each of: the average grain size of the precipitated carbides of the speed tool steel; and, the distribution density of fine particles of the carbides in the tool steel. In other words, as is clear from this finding of the inventors as to the above relationship shown in FIGS. 1 and 2, in order to obtain an impact value equal to or more than 100 J/cm$^2$ in the tool steel, it is necessary to uniformly disperse the fine particles (i.e., precipitated carbides) in the matrix of the tool steel without any agglomeration of these particles or carbides, provided that: an average grain size of the carbides is limited to be equal to or less than 0.5 μm; and, a dispersion density of particles of the carbides is limited to be equal to or more than $80\times10^3$ particles/mm$^2$. The above finding of the inventors as to the relationship shown in FIGS. 1 and 2 makes it possible to improve the tool steel in impact property in a manner such that the tool steel may have an impact value of equal to or more than 200 J/cm$^2$ at maximum without involving any variation in tool performance.

Figures 4, 5:
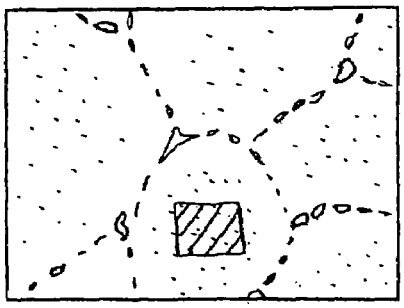
FIG. 4 is a schematic diagram illustrating an observation spot for inspecting the microstructure of the precipitated carbides in the tool steel.
FIG. 5 is a diagram illustrating the effects of the cooling rate of the tool steel after its soaking process.
Figure 9:
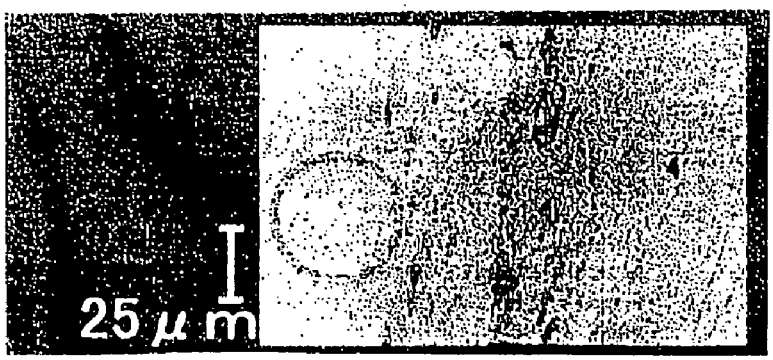
FIG. 9(*a*) is a photomicrograph of the microstructure of the tool steel (specimens) produced by the method of the present invention, illustrating the precipitated carbides of the tool steel.
Figure 9B:
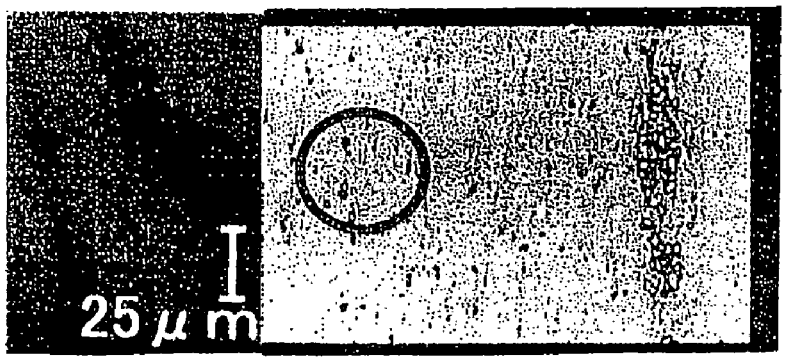

Here, the term "precipitated carbides" shall mean at least one of: a carbide precipitate from the melt during solidification of the steel ingot; a carbide precipitate formed in a solid phase of the steel ingot during a soaking and a hot working process; and, the other carbides not capable of being solid-soluble in the matrix of the tool steel. In general, the term "precipitated carbides" shall mean any carbide not capable of being solid-soluble in the matrix of the tool steel when a quenching process of the tool steel is conducted. However, the term "precipitated carbides" does not mean the other carbides, which are precipitated during a tempering process of the tool steel and not observed in the SEM photograph and/or the microphotograph taken by the optical microscope. FIG. 9(*a*) shows such photomicrograph of the precipitated carbides appearing in the tool steel of the present invention. FIG. 4 shows a schematic diagram illustrating an observation spot for inspecting the microstructure of the precipitated carbides in the tool steel.

As is clear from the above results, it is recognized that: in order to improve the tool steel in impact property to prevent any premature fracture from occurring, it is most important to control the microstructure of the tool steel. Based on this recognition, optimum conditions of the soaking process of the tool steel to control the microstructure thereof have been found, as follows:

Re: Tests Conducted to Determine the Optimum Conditions of the Soaking Process of the Tool Steel:

A first steel ingot, which had a weight of 3 tons, a diameter of 450 mm and a chemical composition shown in the following Table 1, was prepared using an electric furnace. The thus prepared first ingot was then subjected to an electro-slag melting process so that the first ingot was re-melted and formed into a second ingot having a diameter of 580 mm.

TABLE 1

| Chemical Composition of the tool steel (mass %) | | | | | | |
|---|---|---|---|---|---|---|
| C | Si | Mn | P | S | Ni | Cr |
| 0.52% | 0.24% | 0.48% | 0.018% | 0.002% | 0.26% | 4.17% |
| W | Mo | V | Co | Cu | Nb | balance |
| 1.50% | 1.96% | 1.15% | 0.78% | 0.04% | 0.13% | Fe |

The above-mentioned second ingot was then subjected to soaking processes, which varied in holding temperature ranging from 1200° C. to 1300° C. but fixed in holding period of time at 10 hours. In the present invention, cooling conditions after completion of each soaking process of the second ingot were as follows: namely, after completion of the soaking process, the second ingot was cooled down to a temperature of 900° C. in a cooling period of time of 40 minutes, which corresponds to a cooling rate of approximately 7.7 to 10° C./minute. A plurality of test specimens were obtained from this second ingot, and inspected in solid solution state of the carbides of each of the specimens through photomicrographs of these specimens. These photomicrographs are shown in FIGS. 3(*a*), 3(*b*), 3(*c*), 3(*d*) and 3(*e*), wherein the holding temperature of each of the specimens in the soaking processes vary.

Figure 3:
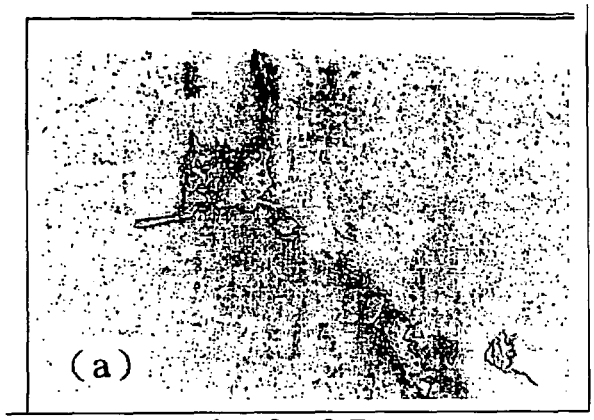
FIGS. 3(*a*), 3(*b*), 3(*c*), 3(*d*) and 3(*e*) are photomicrographs of the microstructures of specimens of the tool steel made with an optical microscope at a magnification of 400 times, illustrating variations in microstructure of the specimens in their soaking tests conducted at various holding temperatures.
Figure 3:
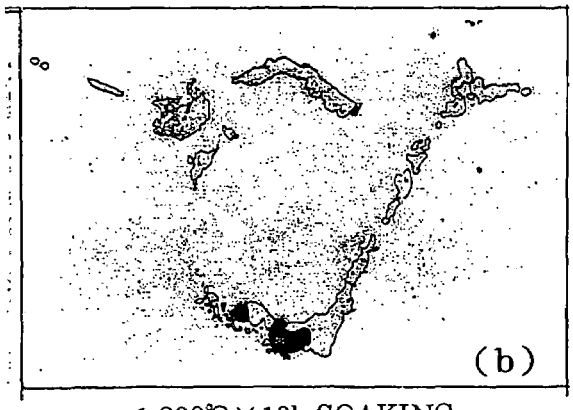
Figure 3:
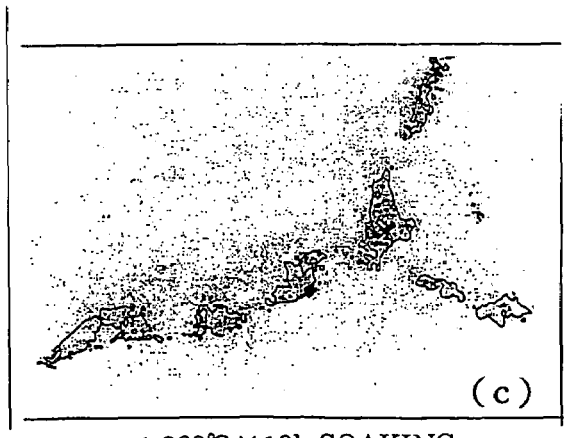
Figure 3:
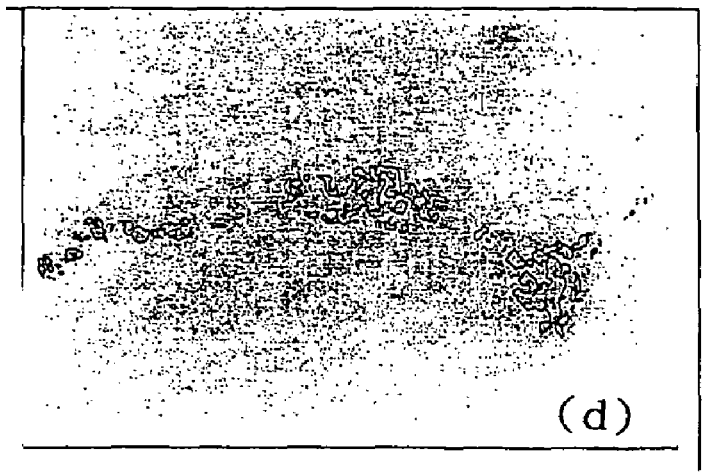
Figure 3:
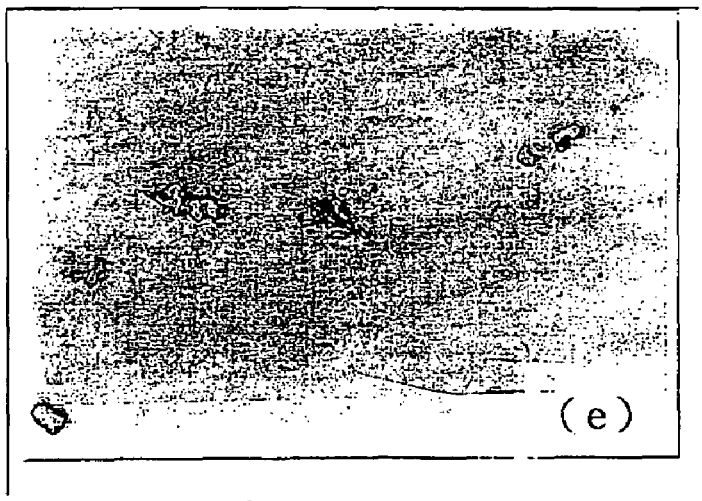

More specifically, FIGS. 3(*a*), 3(*b*), 3(*c*), 3(*d*) and 3(*e*) show photomicrographs of the microstructures of these specimens of the tool steel, taken by an optical microscope at a magnification of 400 times, illustrating variations in microstructure of the specimens in their soaking tests conducted at various holding temperatures. Namely, FIG. 3(*a*) shows a photomicrograph of a first one of the specimens, which one is obtained from the first ingot as cast. FIG. 3(*b*) shows a photomicrograph of a second one of the specimens, which one is obtained from the second ingot having been subjected to the soaking process conducted at a holding temperature of 1200° C. for a holding period of 10 hours. FIG. 3(*c*) shows a photomicrograph of a third one of the specimens, which one is obtained from the second ingot having been subjected to the soaking process conducted at a holding temperature of 1260° C. for a holding period of 10 hours. FIG. 3(*d*) shows a photomicrograph of a fourth one of the specimens, which one is obtained from the second ingot having been subjected to the soaking process conducted at a holding temperature of 1280° C. for a holding period of 10 hours. FIG. 3(*e*) shows a photomicrograph of a fifth one of the specimens, which one is obtained from the second ingot having been subjected to the soaking process conducted at a holding temperature of 1300° C. for a holding period of 10 hours.

As is clear from these drawings, with respect to the holding temperature of the second ingot or tool steel in the soaking process, high (hot) holding temperatures ranging from 1200° C. to 1300° C. are effective in enhancing solid solution of macro-carbides in the ingot or tool steel. The soaking process conducted at such hot holding temperature was followed by a cooling process. The cooling process subsequent to the soaking process is effective in enhancing precipitation of fine particles of the carbides in the ingot or tool steel. Particularly, it is preferable to conduct the soaking process of the tool steel at a hot holding temperature of ranging from 1260° C. to 1300° C. for a holding period of 10 hours. It is more preferable to conduct the soaking process of the tool steel at a hot holding temperature of 1280° C. for a holding period of 10 hours.

Re: Tests of Cooling Conditions of the Tool Steel After Completion of Such Hot Soaking Process;

Then, effects of the cooling conditions of the tool steel after completion of the hot soaking process were researched. Based on the above test results, the hot holding temperature and the holding period of time in the hot soaking process were determined to be 1280° C. and 10 hours, respectively. Under such conditions, the tool steel (i.e., second ingot) was subjected to the soaking process. After completion of the soaking process, the tool steel was cooled down to each of temperature of 1000° C. and 1300° C. at a cooling rate of ranging from 300° C./hour to 30° C./hour. A plurality of specimens were obtained from the thus prepared tool steel (second ingot) and air-cooled.

Figure 6:
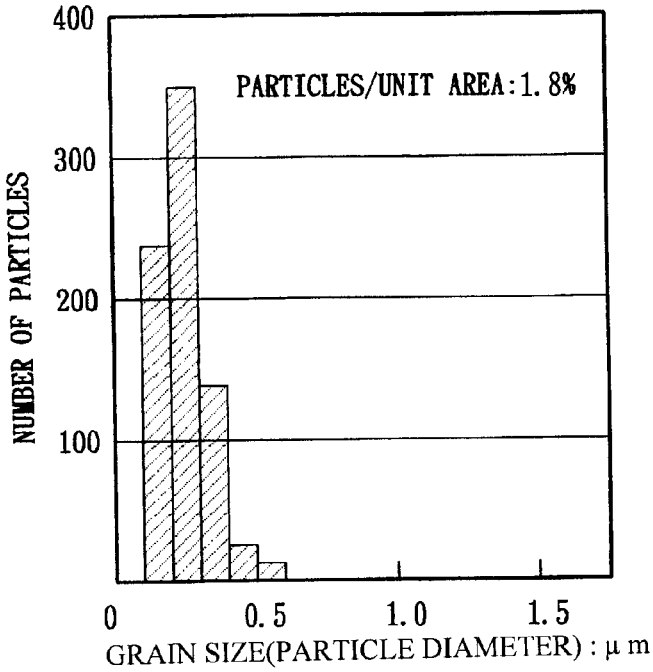
FIG. 6 is a graph showing the average grain size of the tool steel (specimens) when the tool steel shown in FIG. 5 is cooled down to a temperature of 900° C. at a cooling rate of 300° C./hour in surface temperature of the tool steel.
Figure 7:
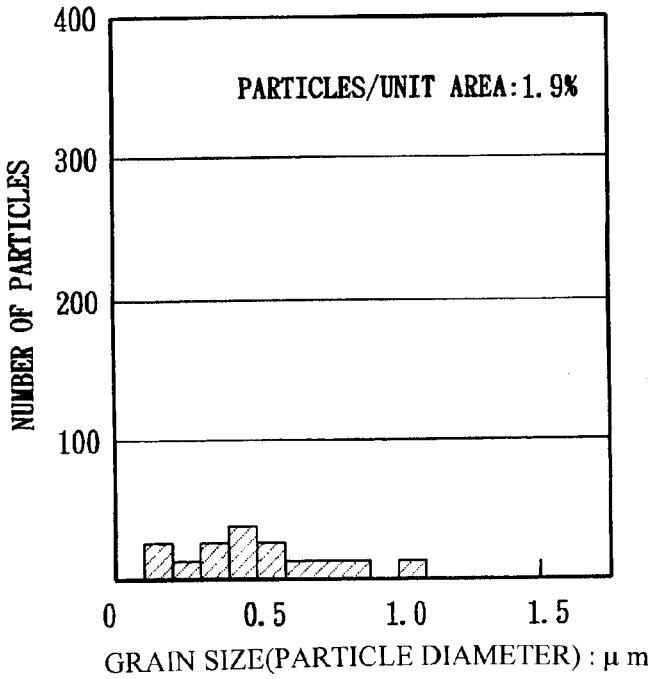
FIG. 7 is a graph illustrating the grain size distribution in the tool steel (specimens) when tool steel shown in FIG. 5 is cooled down to a temperature of 900° C. at a cooling rate of 30° C./hour in surface temperature of the tool steel.

These specimens were observed through their SEM photos as to the precipitated carbides of the tool steel. One of observation spots is shown in FIG. 4, which illustrates a schematic diagram of the precipitated carbides dispersed in the matrix of the tool steel of one of the specimens. The observation results of these specimens as to the precipitated carbides of the tool steel (second ingot) are schematically shown in FIG. 5. As is clear from FIG. 5, the inventors have recognized that: the more the cooling rate decreases, the more the precipitated carbides of the tool steel grow in grain size. FIG. 6 shows a graph illustrating the average grain size distribution in the tool steel (specimens of the second ingot) when the tool steel shown in FIG. 5 is cooled down to a temperature of 900° C. at a cooling rate of 300° C./hour in surface temperature of the tool steel. On the other hand, FIG. 7 shows a graph illustrating the grain size distribution in the tool steel (specimens) when tool steel shown in FIG. 5 is cooled down to a temperature of 900° C. at a cooling rate of 30° C./hour in surface temperature of the tool steel. As is clear from FIG. 6, as for the specimen having cooled at a cooling rate of 300° C./hour (i.e., 5° C./minute), the carbides having a grain size of equal to or less than 0.3 μm are predominant in the microstructure of the tool steel. More particularly, substantially all the carbides of the tool steel shown in FIG. 6 have a grain size of equal to or less than 0.5 μm. On the other hand, as is clear from FIG. 7, as for the specimen having cooled at a cooling rate of 30° C./hour (i.e., 0.5° C./minute), the precipitated carbides having a grain size of 0.8 μm appear in the tool steel.

Based on the above test results, the inventors have recognized that: in order to improve in tool performance the tool steel having the above chemical composition, it is most important to control the cooling rate of the tool steel after completion of the soaking process. Further recognized by the inventors was the fact that: there was substantially no difference in tool performance between the specimen having cooled from a temperature of 1000° C. and another specimen having cooled from a temperature of 900° C.

In view of the above test results, the inventors have determined to cool the second ingot or tool steel to a temperature of equal to or less than 900° C. at a cooling rate of equal to or more than at least 3° C./minute (i.e., 180° C./hour). A preferable value of the cooling rate is equal to or more than 5° C./minute (i.e., 300° C./hour). In the present invention, it is preferable to keep this cooling rate of the ingot or tool steel until its surface temperature reaches 700° C. or less than 700° C.

The method for manufacturing the high speed tool steel of the present invention is applicable to production of the second ingot having an effective diameter of 1500 mm, and remarkably effective in production of the second ingot having an effective diameter of 1000 mm.

Re: Tests Conducted in Production Scale:

In order to confirm the above effects in the specimens, a plurality of confirmation tests were conducted in production scale or line, in which tests the method of the present invention was compared with a comparative method with respect to soaking conditions in the soaking process.

Figure 8A:
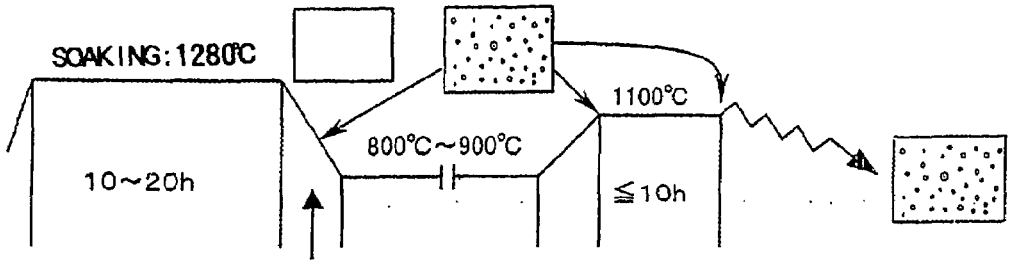
FIG. 8(*a*) is a schematic diagram illustrating a heating pattern of the tool steel in its production test conducted according to the method of the present invention.
Figure 8B:
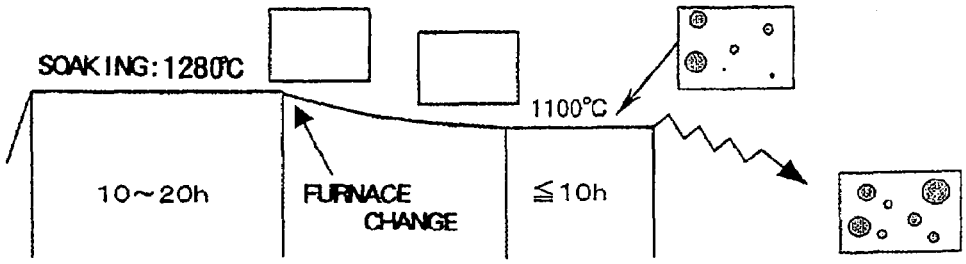

FIG. 8(*a*) shows a schematic diagram illustrating a heating pattern of the tool steel in its production test conducted according to the method of the present invention. On the other hand, FIG. 8(*b*) shows a schematic diagram illustrating a heating pattern of the tool steel in its production test conducted according to a comparative method other than the method of the present invention. More specifically, in the comparative method shown in FIG. 8(*b*), the second ingot, which has been subjected to a so-called "reheating or double electro-slag melting process", was kept at a temperature of 1280° C. in its soaking process. After completion of this hot soaking process, the second ingot was transferred to an electric furnace without any substantial decrease of its surface temperature. In this electric furnace, the second ingot was reheated up to a temperature of 1100° C. corresponding to a hot working temperature of the second ingot, and then subjected to a hot working process such as pressing, rolling and like manipulations. In other words, in the comparative method, the second ingot was subjected to a so-called "blooming operation" and formed into a suitable billet.

In contrast with this, in the method of the present invention shown in FIG. 8(*a*), after completion of the hot soaking process, the second ingot was quickly cooled down to a target temperature of ranging from 900° C. to 800° C. at a cooling rate of equal to or more than at least 3° C./minute (i.e., 180° C./hour) in surface temperature of the ingot, and hold at such target temperature. After that, the second ingot was reheated to a temperature of 1100° C. corresponding to a hot working temperature of the second ingot, and then subjected to a hot working process such as pressing, rolling and like manipulations. In other words, in the method of the present invention, the second ingot was subjected to the blooming operation and formed into a suitable billet. The billet was then subjected to a hot-rolling operation and formed into a steel bar having a diameter of 80 mm.

Figure 10:
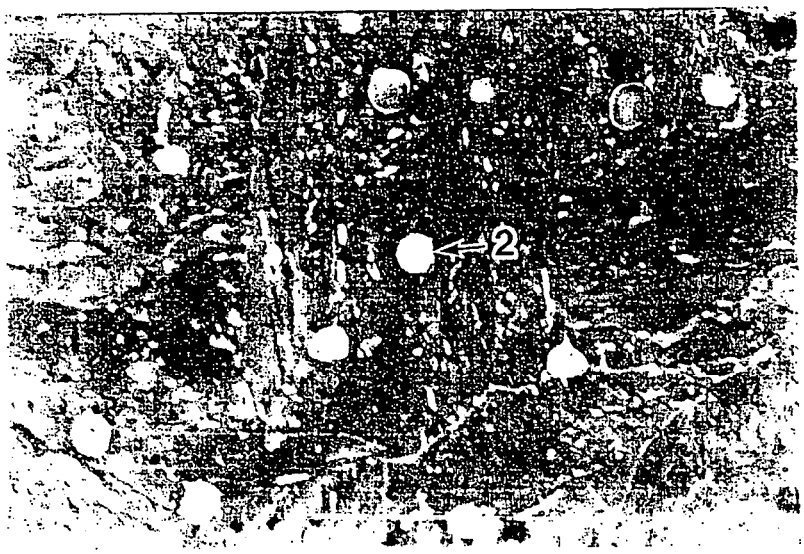
FIG. 10(*a*) is an SEM (i.e., Scanning Electron Microscopy) photograph showing the microstructure of the precipitated carbides of the tool steel produced by the method of the present invention.
Figure 10:
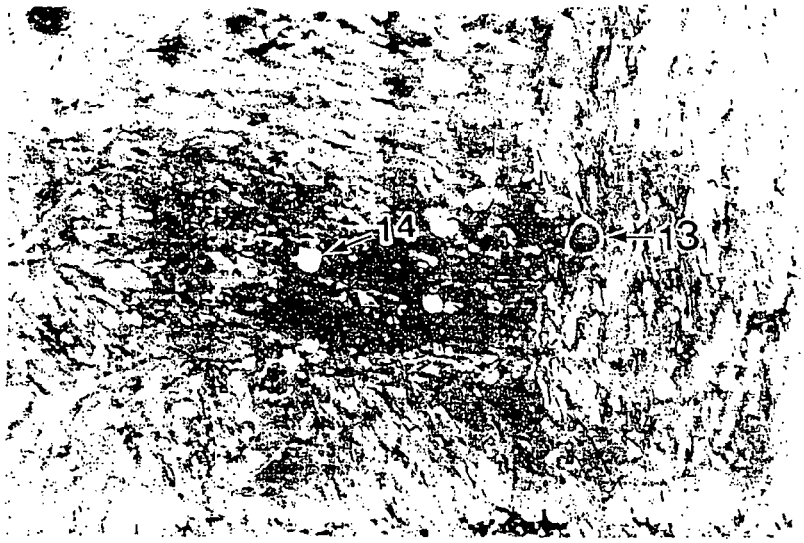

A plurality of specimens were obtained from this steel bar and quenched at a temperature of 1140° C. The thus quenched specimens were then subjected to a tempering process conducted at a temperature of 560° C. The thus prepared specimens were observed using a plurality of SEM photos and a microscope. FIG. 9(*a*) shows a photomicrograph of the microstructure of the tool steel (specimens) produced by the method of the present invention, illustrating the precipitated carbides of the tool steel. This photomicrograph was made with an optical microscope at a magnification of 400 times. FIG. 9(*b*) shows a photomicrograph of the microstructures of the tool steel (specimens) produced by a comparative method other than the method of the present invention. This photomicrograph was made with the optical microscope at a magnification of 400 times. The corresponding SEM photos of the specimens were taken at a magnification of 10000 times and are shown in FIGS. 10(*a*) and 10(*b*). More particularly, FIG. 10(*a*) shows the SEM photograph of the specimens, illustrating the microstructure of the precipitated carbides of the specimens (tool steel) produced by the method of the present invention. On the other hand, FIG. 10(*b*) shows the SEM photograph of the specimens (tool steel), illustrating the microstructure of the precipitated carbides of the specimens (tool steel) produced by the comparative method. In observation of the carbides of the specimens, these SEM photographs were copied in shape of the carbides and subjected to image analysis to inspect the microstructure of the carbides.

As a result, as is clear from FIG. 10(*a*), in each specimen produced by the method of the present invention, the precipitated carbides in the matrix of each specimen have an average grain size of 0.43 μm. On the other hand, a distribution density of the precipitated carbides in each specimen was $220\times10^3$ particles/mm$^2$, in which the particles of the precipitated carbides were dispersed in the steel matrix of each specimen. Further, in the observation spot or area having a diameter of 15 mm in the microphotograph taken at a magnification of 400 times, the number of particles of the carbides having an average grain size of from 1 μm to 20 μm was up to only 20 particles.

In contrast with this, in each specimen (hereinafter referred to as "comparative steel") produced by the comparative method, the precipitated carbides in the matrix of each specimen have an average grain size of 1.0 μm. On the other hand, a distribution density of the precipitated carbides in each specimen was $50\times10^3$ particles/mm$^2$, in which the particles of the precipitated carbides were dispersed in the steel matrix of each specimen. Further, in the observation spot or area having a diameter of 15 mm in the microphotograph taken at a magnification of 400 times, the number of particles of the carbides having an average grain size of from 1 μm to 20 μm reached 30–40 particles.

The impact test results of the above specimens are shown in the following Table 2:

TABLE 2

| | Impact test results of the tool steel; | | | | | |
|---|---|---|---|---|---|---|
| | Hardness (HRC) | Impact values (J/cm$^2$) | | | | |
| Tool Steel of the Invention | 57.6 | 222.0 | 242.8 | 230.1 | 249.1 | 247.5 |

TABLE 2-continued

| | Impact test results of the tool steel; | | | | | |
|---|---|---|---|---|---|---|
| | Hardness (HRC) | Impact values (J/cm$^2$) | | | | |
| Comparative Steel | 57.1 | 98.7 | 83.6 | 111.2 | 60.9 | 112.7 |

As is clear from this Table 2, although the comparative steel obtained an impact value of the order to approximately 110 J/cm$^2$, the individual impact values of the comparative steel have widely varied. In contrast with this, the tool steel of the present invention obtained an impact value of equal to or more than 200 J/cm$^2$. Further, the tool steel of the present invention had substantially no variation in impact value. Due to this, it has been observed that: a forging punch, which was made of the tool steel of the present invention, was remarkably improved in tool life.

As described in the above, in the method of the present invention for manufacturing the high speed tool steel, the tool steel of the present invention comprises, by mass percentage, a basic composition of: a 0.4–0.9% of C; an equal to or less than 1.0% of Si; an equal to or less than 1.0% of Mn; a 4–6% of Cr; a 1.5–6% in total of either or both of W and Mo in the form of (½W+Mo) wherein the amount of W is not more than 3%; and, a 0.5–3% in total of either or both of V and Nb in the form of (V+Nb), wherein an ingot of the tool steel is prepared by an electro-slag melting process, heated to a temperature of from 1200° C. to 1300° C., subjected to a soaking process, and then cooled down to a temperature of equal to or less than 900° C. at a cooling rate of equal to or more than 3° C./minute in surface temperature of the ingot, the ingot being then subjected to a hot working process.

As preferable additional ingredients or elements to be added to the tool steel of the present invention, there are Ni and Co. Preferably: Ni is added to the tool steel of the present invention by an amount of equal to or less than 1.0 mass %; and, Co is added to the tool steel of the present invention by an amount of equal to or less than 5 mass %.

Namely, in the chemical composition of the high speed tool steel of the present invention, a carbon content and the other elements both contributing formation of the carbides are well-balanced so as to: decrease the distribution density of stripe-like or streak-like carbides to limit an amount of the carbides; and, disperse the fine particles of the carbides in the matrix of the tool steel uniformly. Further, addition of an appropriate amount of each of Ni and Nb to the tool steel may enhance formation of fine crystals of the carbides in the matrix of the tool steel, and therefore enhance the improvement of the tool steel in resistance to softening at high temperatures, which leads to the improvement in tool life of the tool product made of the tool steel.

As described in the above, it is possible to obtain the tool steel of the present invention, which steel is remarkably improved in tool life. In the tool steel of the present invention having been subjected to the quenching and the tempering process, the average grain size of the precipitated carbides dispersed in the matrix of the tool steel is equal to or less than 0.5 μm. On the other hand, the distribution density of the carbides in the tool steel of the present invention is equal to or more than $80\times10^3$ particles/mm$^2$. Due to the above facts, it is possible for the tool steel of the present invention to obtain an impact value of equal to or more than 200 J/cm$^2$, without suffering from any variation in impact value.

Consequently, it is possible for a tool product made of the tool steel of the present invention to prevent the premature fracture of the tool product from occurring, which leads to the remarkable improvement of the tool steel of the present invention in tool life and in manufacturing cost.

Re: The Effects of the Present Invention:

As described above, in the high speed tool steel of the present invention and the method of the present invention for manufacturing the tool steel, the tool steel of the present invention is remarkably improved in impact property after completion of its quenching and the tempering process in comparison with the conventional type of high speed tool steel. Further, the tool steel of the present invention has less variation in tool performance. Due to introduction of these improvements, the tool product made of the tool steel of the present invention is substantially free from any premature fracture, and therefore improved in tool life. Further, it is also possible to manufacture at low cost both the tool steel and the tool product made thereof according to the present invention.

Finally, the present application claims the Convention Priority based on Japanese Patent Application No. 2003-105387 filed on May 12, 2003, which is herein incorporated by reference.

What is claimed is:

1. A high speed tool steel comprising, by mass percentage, a basic composition of: a 0.4–0.9% of C; an equal to or less than 1.0% of Si; an equal to or less than 1.0% of Mn; a 4–6% of Cr; a 1.5–6% in total of either or both of W and Mo in the form of (½W+Mo) wherein the amount of W is not more than 3%; and, a 0.5–3% in total of either or both of V and Nb in the form of (V+Nb), wherein an average grain size of precipitated carbides dispersed in the matrix of the steel is equal to or less than 0.5 μm and a dispersion density of the carbides is equal to or more than $80\times10^3$ particles/$mm^2$, wherein the tool steel is formed by an ingot casting process.

2. The high speed tool steel as set forth in claim 1, wherein an Ni content is equal to or less than 1% by mass percentage.

3. The high speed tool steel as set forth in claim 1, wherein a Co content is equal to or less than 5% by mass percentage.

4. The high speed tool steel as set forth in claim 1, wherein an Ni content is equal to or less than 1% by mass percentage, and a Co content is equal to or less than 5% by mass percentage.

* * * * *